US006360909B1

(12) United States Patent
Bridge

(10) Patent No.: US 6,360,909 B1
(45) Date of Patent: Mar. 26, 2002

(54) CONTAINER CLOSURE HAVING A FRANGIBLE SEAL

(75) Inventor: Mike Bridge, Brussels (BE)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/506,647

(22) Filed: Feb. 18, 2000

(51) Int. Cl.[7] ..... B65D 51/22; B65D 17/34

(52) U.S. Cl. ..... 220/258; 220/259; 220/270; 220/847; 220/834; 220/276

(58) Field of Search ..... 220/265, 266, 220/270, 276, 258, 259, 254, 256, 375, 833, 835, 847, 837, 834

(56) References Cited

U.S. PATENT DOCUMENTS

| | | | | | |
|---|---|---|---|---|---|
| 2,630,237 | A | | 3/1953 | Rosenlof | |
| 2,690,861 | A | * | 10/1954 | Tupper | 220/847 |
| D174,205 | S | | 3/1955 | Ward | |
| D188,393 | S | | 7/1960 | Fagan | |
| D193,121 | S | | 6/1962 | Wickman | |
| 3,081,926 | A | | 3/1963 | Newton | |
| 3,117,702 | A | | 1/1964 | Henchert | |
| 3,160,327 | A | | 12/1964 | Porcelli | |
| 3,172,558 | A | | 3/1965 | Wilkinson | |
| 3,182,852 | A | | 5/1965 | Wilkinson | |
| 3,184,096 | A | | 5/1965 | Cheeley | |
| 3,187,930 | A | | 6/1965 | Henchert | |
| 3,187,931 | A | | 6/1965 | Henchert | |
| 3,208,627 | A | | 9/1965 | Lipske | |
| 3,239,112 | A | | 3/1966 | Porcelli | |
| D205,426 | S | | 8/1966 | Dunn | |
| 3,281,007 | A | | 10/1966 | Dorosz | |
| 3,282,477 | A | | 11/1966 | Henchert | |
| 3,339,790 | A | * | 9/1967 | Murdock | 220/270 |
| 3,385,471 | A | | 5/1968 | Dunn | |
| 3,419,181 | A | | 12/1968 | Stec | |
| 3,434,620 | A | | 3/1969 | Laurizio | |
| 3,458,080 | A | | 7/1969 | Laurizio | |
| 3,462,048 | A | | 8/1969 | Henchert | |
| 3,469,725 | A | | 9/1969 | Turner | |
| 3,485,416 | A | | 12/1969 | Fohrman | |
| 3,495,746 | A | | 2/1970 | Laurizio | |
| 3,734,333 | A | | 5/1973 | Foss | |
| 3,754,678 | A | | 8/1973 | Fox et al. | |
| 3,762,597 | A | | 10/1973 | Kaminski et al. | |
| 3,804,305 | A | | 4/1974 | Rieke | |
| 3,850,330 | A | | 11/1974 | Koontz et al. | |
| 3,860,135 | A | | 1/1975 | Yung et al. | |
| 3,961,722 | A | * | 6/1976 | Bozek | 220/270 |
| 3,998,354 | A | | 12/1976 | Song | |
| 4,022,357 | A | | 5/1977 | Dwinell | |
| 4,029,202 | A | | 6/1977 | Lasich et al. | |
| 4,030,630 | A | | 6/1977 | Yealy | |
| D257,933 | S | | 1/1981 | Conti | |
| D258,496 | S | | 3/1981 | Ludwig, Jr. et al. | |
| 4,256,239 | A | * | 3/1981 | Yamaguchi et al. | 220/270 |

(List continued on next page.)

*Primary Examiner*—Nathan J. Newhouse
(74) *Attorney, Agent, or Firm*—Drinker Biddle & Reath LLP

(57) ABSTRACT

A closure for sealing a product container. The closure includes a body, a frangible seal and a lid. The body includes a flange which projects downward from the seal and a skirt which projects upward from the seal. The flange is engagable with the interior surface of the container and the skirt retains a reclosable lid in its closed position. The frangible seal covers an opening in the body and has a tear strip which is defined by a pair of spaced-apart grooves. An integral finger grip is located at one end of the tear strip. The finger grip has a pair of upwardly-angled gripping tabs which are attached to the tear strip by a spacer. The lid is tethered to the skirt and includes a lifting tab. The tether and the lifting tab are located in respective notches in the upper edge of the skirt when the lid is closed.

15 Claims, 3 Drawing Sheets

U.S. PATENT DOCUMENTS

| | | | | | |
|---|---|---|---|---|---|
| D263,799 | S | | 4/1982 | Nilsson | |
| 4,397,400 | A | | 8/1983 | Walter | |
| 4,407,423 | A | | 10/1983 | Walter | |
| D271,284 | S | | 11/1983 | Bainton | |
| D272,323 | S | | 1/1984 | Bainton | |
| 4,432,466 | A | | 2/1984 | Allen | |
| D274,792 | S | | 7/1984 | Price | |
| D275,655 | S | | 9/1984 | Bainton | |
| D286,028 | S | | 10/1986 | DiFede | |
| 4,682,702 | A | * | 7/1987 | Gach | 220/258 |
| 4,724,978 | A | | 2/1988 | Cleevely et al. | |
| 4,724,979 | A | | 2/1988 | Cleevely et al. | |
| 4,738,376 | A | * | 4/1988 | Markus | 220/254 |
| 4,895,270 | A | | 1/1990 | Main et al. | |
| 4,895,282 | A | | 1/1990 | Robinson | |
| D314,338 | S | | 2/1991 | Piltz | |
| 5,020,686 | A | | 6/1991 | Dutt | |
| D318,220 | S | | 7/1991 | Stenberg et al. | |
| D319,982 | S | | 9/1991 | Matthews | |
| D320,560 | S | | 10/1991 | Allen | |
| D322,760 | S | | 12/1991 | Blanchette | |
| 5,083,671 | A | | 1/1992 | Hayes | |
| 5,085,339 | A | | 2/1992 | Roth et al. | |
| 5,114,507 | A | | 5/1992 | Piltz et al. | |
| 5,119,955 | A | | 6/1992 | Granofsky | |
| 5,121,851 | A | | 6/1992 | Lyon et al. | |
| 5,125,528 | A | | 6/1992 | Heyn et al. | |
| D328,567 | S | | 8/1992 | Berry | |
| 5,139,163 | A | | 8/1992 | Diaz | |
| 5,273,176 | A | | 12/1993 | Diaz | |
| 5,301,827 | A | | 4/1994 | Valyi | |
| 5,310,081 | A | | 5/1994 | McCabe | |
| 5,353,943 | A | | 10/1994 | Hayward | |
| D353,328 | S | | 12/1994 | Nuffer | |
| D359,234 | S | | 6/1995 | Amin | |
| D371,485 | S | | 7/1996 | Hickey | |
| D374,401 | S | | 10/1996 | Behnen, Jr. | |
| 5,655,706 | A | * | 8/1997 | Vandiver | 220/847 |
| 5,657,894 | A | * | 8/1997 | Bowen | 220/847 |
| D384,282 | S | | 9/1997 | Wong | |
| 5,713,484 | A | | 2/1998 | Setty | |
| 5,758,793 | A | | 6/1998 | Forsyth et al. | |
| 5,855,288 | A | | 1/1999 | Dallas, Jr. | |
| 5,875,942 | A | | 3/1999 | Ohmi et al. | |

* cited by examiner

CONTAINER CLOSURE HAVING A FRANGIBLE SEAL

FIELD OF THE INVENTION

The present invention generally relates to closures for containers. In particular, the present invention relates to a container closure having frangible seals.

BACKGROUND OF THE INVENTION

In the packaging of many products it is desirable to seal the containers. Containers, particularly those for comestibles, are typically provided with frangible seals that protect the contents of the containers during shipment and storage. The frangible seats can also act as indicators that signal a user of possible product tampering. While providing these benefits, manufacturers desire to minimize the cost that the seals add to the containers and provide seals that are easy to use.

One kind of frangible seal is a membrane which includes a groove or score line that defines a removable portion of the seal. The groove provides a line of weakness along which the seal is torn when it is removed from the container. Some frangible seals also include a tear strip which encircles the removable portion of the seal. The tear strip is formed integrally with the seal and is defined by a pair of spaced-apart grooves which encircle the seal. An integral finger grip may be provided at one end of the tear strip to pull it away from the container.

One type of finger grip includes a generally flat ring through which a user puts a finger to apply a pulling force. This type of finger grip can be uncomfortable to use because the ring often is too thin for the pulling force required. In addition, ring-type finger grips are frequently difficult to initially grasp because of their awkward location, which is typically flat against the outer surface of the seal.

Another type of finger grip is generally formed as a flat, flexible tab that either projects away from the outer surface of the seal or lies flat against it. Flexible-type finger grip can easily slip from a user's grip because these tabs are frequently thin and narrow and have smooth gripping surfaces. To prevent slippage, serrations have sometimes been provided on one or both faces. Flexible finger grips that lay flat against the seal can be difficult to initially grip.

Yet another type of finger grip includes a lever formed generally by a relatively large, rigid tab that acts as a lever to initially break the seal. After the seal is initially broken, the tab is used to pull the seal or the tear strip along the one or more grooves. Lever-type finger grips are relatively costly to manufacture because of the rigidity required to function as a lever. In addition, this type of finger grip is typically closely spaced from the seal can be difficult to initially grasp.

Typically, frangible seals are formed integrally with body portions into closure members which are separate from the containers. After the containers are filled with product, the closure members are attached to the containers, which are then sealed. Current methods of attaching closure members to containers result in the peripheral edges of the closures projecting beyond the outer surfaces of the containers. For example, metal closure members which close metal containers are crimped to the walls of the container. The crimped joints are then rolled outward from the containers. Also, plastic and metal closures used to seal plastic or cardboard containers have flanges that engage the outer peripheries of the containers. These flanges projected beyond the walls of the containers and can catch edges of similar containers or other items, making the containers inconvenient to ship, store and use.

Some containers having frangible seals are also provided with reclosable lids which are used to reseal the containers after the frangible seal has been removed. Reclosable lids allow a user to conveniently use the container to store contents that are not emptied at one time or that may be used outside of the container and returned to the container until further use. An example of the first type of content is a powdered drink mix that is mixable with water to make several gallons of flavored drink. Frequently, a user desires to use only a small portion of the mix at one time and return the rest to storage. An example of the second type of content is tennis balls. Typically, tennis balls are packaged in resealable cans. The balls may be used more than once, and users frequently return them to the original container to store them until the next time they are needed.

Conventional reclosable lids are often not attached to the containers and can be easily misplaced. In addition, most reclosable lids have peripheral flanges which provide snap fits to the rolled edges or flanges of the closures. The outer edges of these flanges can easily catch on other items which can cause the lids to open inadvertently.

SUMMARY OF THE INVENTION

The present invention comprises a closure for a container. The closure includes a body having an inner periphery and an outer periphery. A removable seal made from a thin, tearable material engages the inner periphery of the body and covers an opening defined thereby. The seal has a tear strip which is at least partially defined by a pair of spaced-apart grooves in the seal and has a starting end. A finger grip is located adjacent the starting end and includes a pair of finger tabs which are substantially parallel to the seal and have a proximal and a distal end. The proximal ends of the finger tabs are connected to the tear strip adjacent each other and the distal ends of the finger tabs project in a direction at least partially away from each other.

A further aspect of the invention provides a body having a flange which is engagable with the interior surface of a wall of a container. A skirt is located upwardly adjacent the flange and engages a removable lid. The lid is attached to the skirt by a tether. The lid also has a lifting tab located opposite the tether. When the lid is in its closed position, the lifting tab and the tether are located in notches within the upper edge of the skirt. In a further aspect of the invention, the flange and the skirt are offset by the thickness of a wall of a container to which closure will be attached. The offset allows the outer periphery of the skirt to be flush with the outer periphery of the container when the closure is attached to the container.

BRIEF DESCRIPTION OF THE DRAWINGS

For the purposes of illustrating the invention, the drawings show a form of the invention which is presently preferred. However, it should be understood that this invention is not limited to the precise arrangements and instrumentalities shown in the drawings.

DETAILED DESCRIPTION OF THE DRAWINGS

Figure 1:
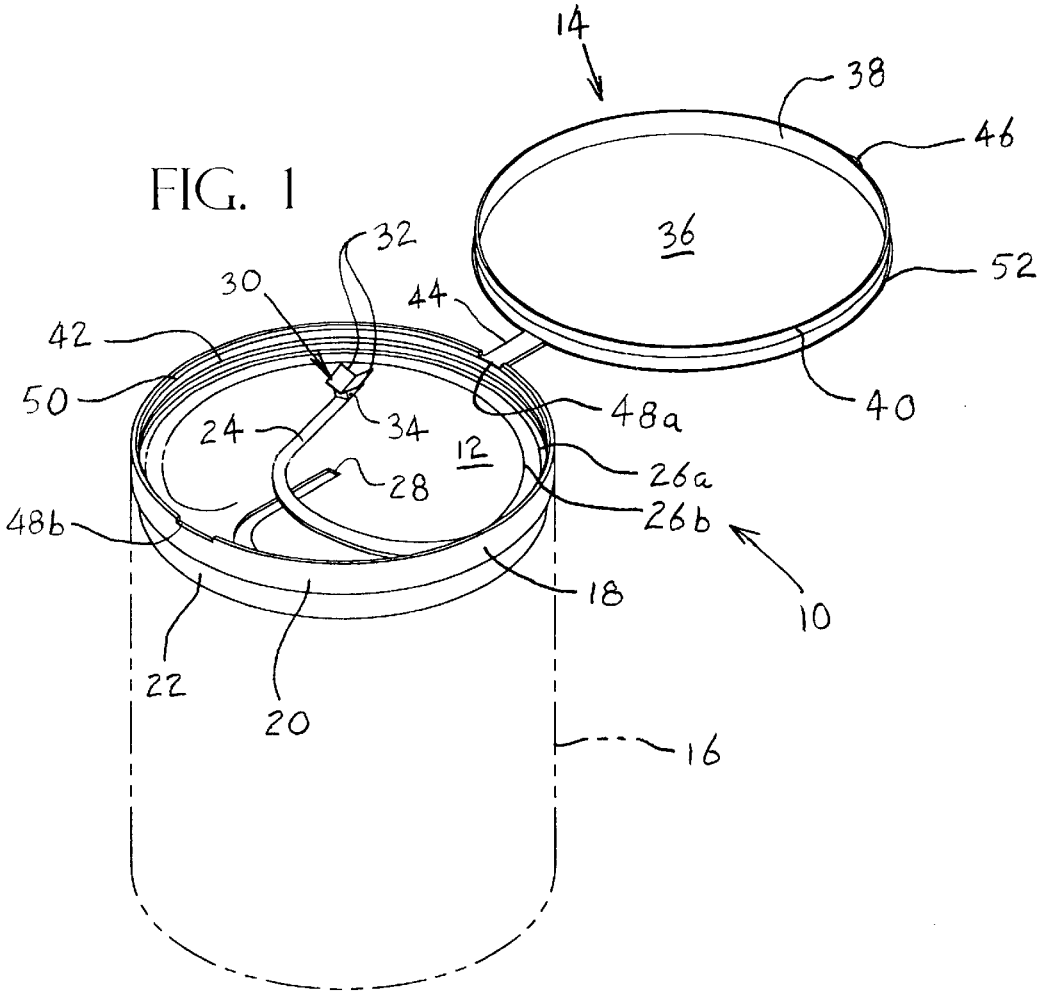
FIG. 1 is a perspective view of a container closure according to the present invention showing the lid in an open position and the frangible strip partially torn away from the seal.
Figure 2:
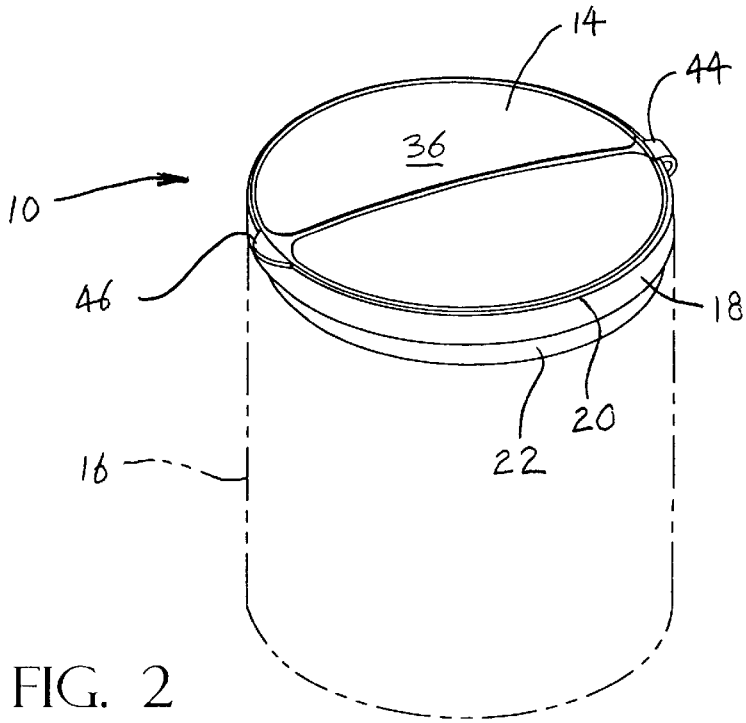
FIG. 2 is a perspective view of the container closure which shows the lid in the closed position.

Referring to the drawings, wherein like numerals indicate like elements, FIGS. 1 and 2 illustrate a container closure which is designated generally by the numeral 10. The closure 10 includes a frangible seal 12 and a lid 14. FIG. 1 shows the lid 14 in an open position and FIG. 2 shows the lid 14 in its closed position. The closure 10 may be used with conventional containers such as a cylindrical can 16 used to package comestibles. However, the closure may be used with any container where it is desired to have a factory-sealed container that is reclosable once the seal has been broken. The seal 12 preferably is airtight and designed to hold a vacuum which is applied to the container as part of a manufacturer's packaging process.

The closure 10 is preferably made of a plastic and comprises a body 18 to which the frangible seal 12 and the lid 14 are attached. The body 18 includes a skirt 20 which engages and retains the lid 14 in its closed position and a flange 22 which attaches the closure 10 to the can 16. In the embodiment shown, the outer periphery of the flange 22 is sized to snugly engage the inner surface of the can 16. An adhesive is typically used between the flange 22 and the can 16 to secure them together and provide an airtight joint. The frangible seal 12 is attached around its entire periphery to the upper end of the flange 22 and covers an opening defined by the inner periphery of the flange 22.

The frangible seal 12 includes a tear strip 24 defined by a pair of spaced-apart grooves 26. The seal 12 and the tear strip 24 preferably are integrally formed and are substantially the same thickness. The grooves 26 define lines of weakness along which the tear strip 24 is separated from adjacent portions of the seal 12 when the seal is removed. When the tear strip 24 is completely torn along the grooves 26, the seal 12 separates from the body 14 of the closure 10.

The tear strip 24 has a starting end 28 located at approximately the center of the seal 12. The outer groove 26*a* runs continuously around the periphery of the seal 12, and the inner groove 26*b* ends short of forming a complete circle. The end of the tear strip 24 opposite the starting end 28 is joined to the seal 12 by the full thickness of the seal 12. Thus, when the tear strip 24 is torn away along the lengths of both grooves 26, the tear strip 24 remains attached to the portion of the seal 12 removed from the body 14. FIG. 1 shows the tear strip 24 partially torn from the seal 12.

The tear strip 24 has a finger grip 30 located adjacent its starting end 28. The finger grip 30 includes a pair of gripping tabs 32 and a spacer 34. The gripping tabs 32 and spacer 34 are preferably integrally formed with the tear strip 24. The gripping tabs 32 preferably are angled generally upward and outward from the spacer 34 in a V-shape. To begin removing the tear strip 24 from the seal 12, a user pinches the finger grip 30 between an index finger and a thumb of one hand. The gripping tabs 32 preferably are made of a resilient plastic and are relatively thin to allow them to flex generally upwardly and toward each other when pinched. The spacer 34 spaces the gripping tabs 32 far enough from the seal 12 that the gripping tabs 32 may be gripped comfortably and firmly.

The lid 14 has a cover 36 which covers an opening defined by the inner periphery of the skirt 20. An apron 38 is attached to the cover 36 and engages the inner periphery of the skirt 20 when the lid is in its closed position. The lid 14 is retained in its closed position by a snap fit between a boss 40 on the outer periphery of the apron 38 and a locking rib 42 on the inner periphery of the skirt 20. Both the boss 40 and the locking rib 42 are continuous around the peripheries of the respective members. This provides a continuous interlock between the lid 14 and the body 18. Although a continuous boss and locking rib retaining means is preferred, other retaining means such an intermittent boss and locking rib, a slot and a tab, friction fit, or the like may be used.

The lid 14 is attached to the body 18 by a flexible tether 44 which provides a hinge that allows the lid 14 to be easily moved between an open position and the closed position. The tether 44 is preferably formed integrally with the lid 14 and the body 18, but may be formed separately and attached to the body 18 and the lid 14 by welding, adhesive or the like. A lifting tab 46 is attached to the lid 14 diametrically opposite the tether 44. The lifting tab 46 is preferably formed integrally with the lid 14. When the lid 14 is in its closed position, the lifting tab 46 projects beyond the outer periphery of the skirt 20.

The upper edge of the skirt 20 has a pair of notches 48. When the lid is closed, notch 48*a* received the tether 44 and notch 48*b* receives the lifting tab 46. The depths of the notches 48 corresponds to the respective thicknesses of the tether 44 and the lifting tab 46 such that when the lid 14 is in its closed position, the upper edge of the skirt 20 is substantially flush with the upper faces of the tether 44 and the lifting tab 46. The upper edge of the lid 14 also has a bevel 50 adjacent its inner periphery which guides the apron 38 into the skirt when closing the lid 14. The bevel 50 abuts a corresponding chamfer 52 on the periphery of the cover 36 when the lid is in its closed position.

The factory-sealed can 16 is typically distributed and sold with the frangible seal 12 intact and with the lid 14 in its closed position. Once a consumer purchases the container, he initially opens it by first opening the lid 14 and then removing the frangible seal 12. When the consumer wishes to close the container, he simply returns the lid 14 to its closed position. The closure 10 is designed such that the lid 14 may be opened and closed multiple times after the container is initially opened. In this manner, the contents of the container can be used in increments or re-accessed over a period of time while the contents are substantially protected from the environments, e.g. light, dust, odor and the like, between the periodic openings.

Although the closure 10 is shown closing an entire open end of the can 16, the closure 10 may be used to close smaller openings. For example, the closure 10 may be mounted within a circular aperture in an upper wall of a container which has a diameter greater than that of the closure 10. It is preferred that the closure 10 be formed as a single piece. However, the closure 10 may be made from two or more pieces joined by adhesive, welding, mechanical fasteners or the like.

Figure 3:
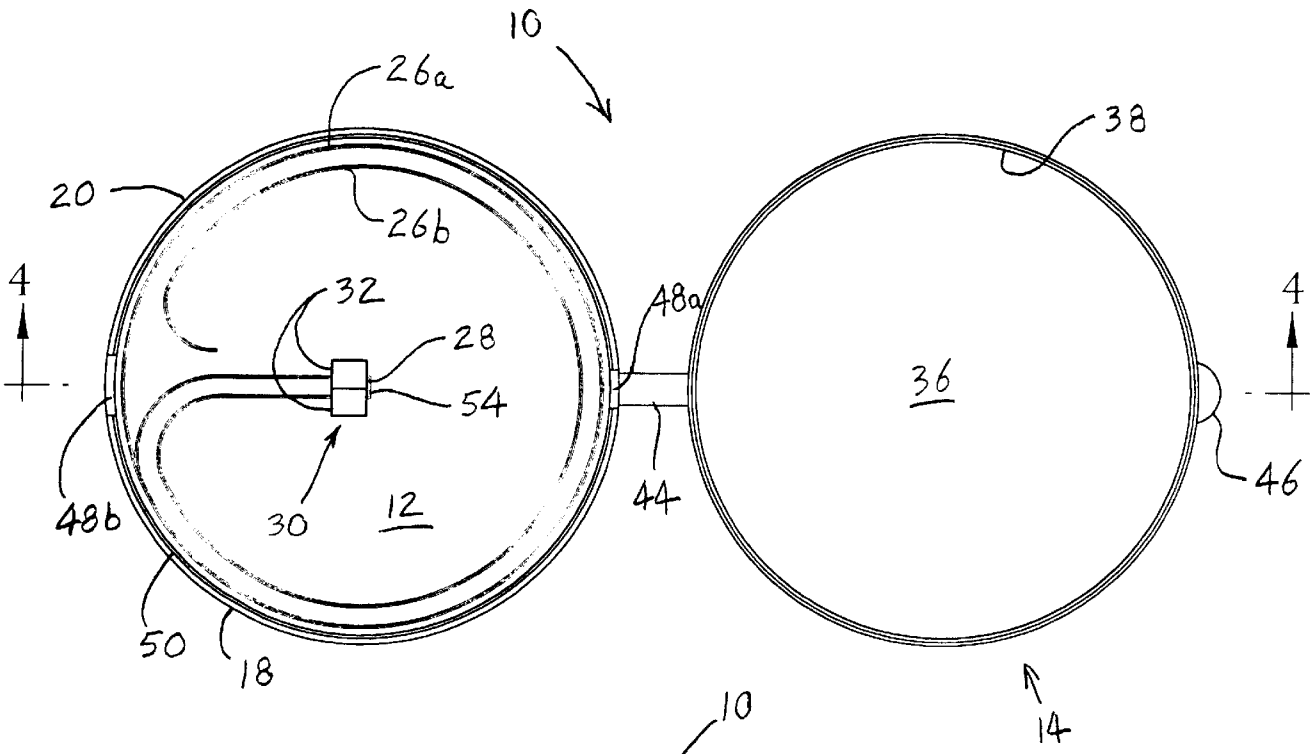
FIG. 3 is a top view of the container closure.
Figure 4:
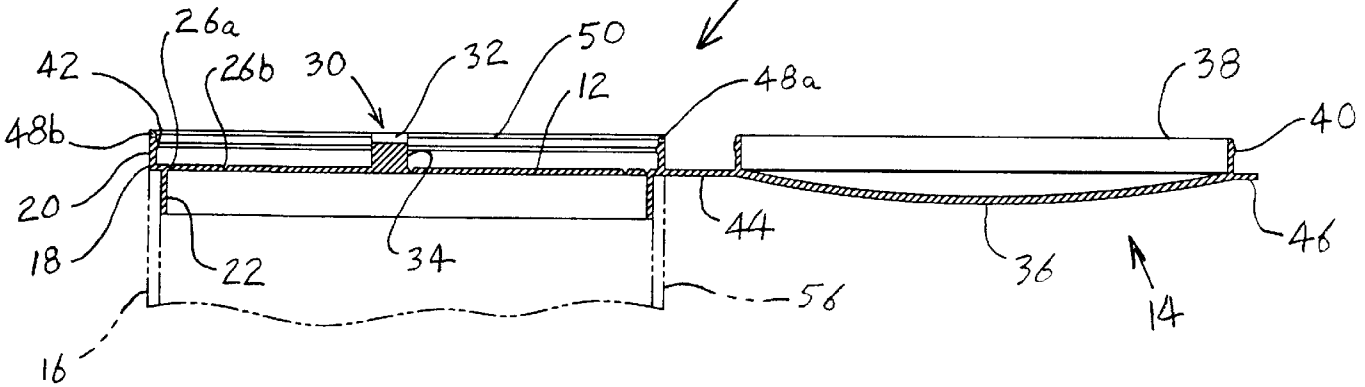
FIG. 4 is a cross-sectional view of the container closure taken along line 4—4 of FIG. 3.

Referring now to FIGS. 3 and 4, FIG. 3 is a plan view of the closure 10 and FIG. 4 is a cross sectional view taken along line 4—4 of FIG. 3. FIGS. 3 and 4 show the lid 14 in an open position and the frangible seal 12 and the tear strip 24 fully intact. The starting end 28 of the tear strip 24 is defined by a connecting groove 54 which connects adjacent ends of the spaced-apart grooves 26. The spaced-apart grooves 26 and the connecting groove 54 are generally V-shaped shaped grooves in the upper surface of the seal 12.

Although V-shaped grooves are shown, the grooves 26, 54 may be other shapes such as rectangular or U-shaped. Alternatively, the grooves 26, 54 may be replaced by score lines. The depths of the grooves 26, 54 are selected based on the material used for the seal 12 and either the force required to tear the strip 24 from the seal 12 or the pressure inside the container, whichever governs.

The cover 36 of the lid 14 is generally dome-shaped within the inner periphery of the apron 38. However, the cover 36 may be another shape such as flat, pyramidal or the like. The tether 44 is attached at one end to the outer periphery of the cover 36 and at the other end to the skirt 20, opposite the seal 12. Although the tether 44 may be attached at other locations, those shown are preferred because they simplify the molding process wherein the closure 10 is cast as a single piece.

FIG. 4 illustrates the relationship between the closure 10 and the can 16. The outer peripheries of the skirt 20 and the flange 22 are offset by a distance substantially equal to the thickness of the wall 56 of the can 16. This allows the outer periphery of the skirt 20 to be substantially flush with the outer face of the can 16 while the outer periphery of the flange 22 contacts the inner face of the can 16. A shoulder 58 is formed by an offset between the skirt 20 and the flange 22 and abuts the upper edge of the wall 56 of the can 16. The outside diameter of the flange 22 is chosen to provide a friction fit between the flange 22 and the can 16. Alternatively, the fit may be a snap fit, a mechanical interlock using serrations on the outer surface of the flange 22 or the like. The contact surfaces between the flange 22 and the can 16 preferably are bonded together with an adhesive. The height of the flange 22 is generally selected based on the adhesive used and the bond strength required. Adhesive may also be applied between the shoulder 58 and the upper edge of the wall 56.

Figure 5:
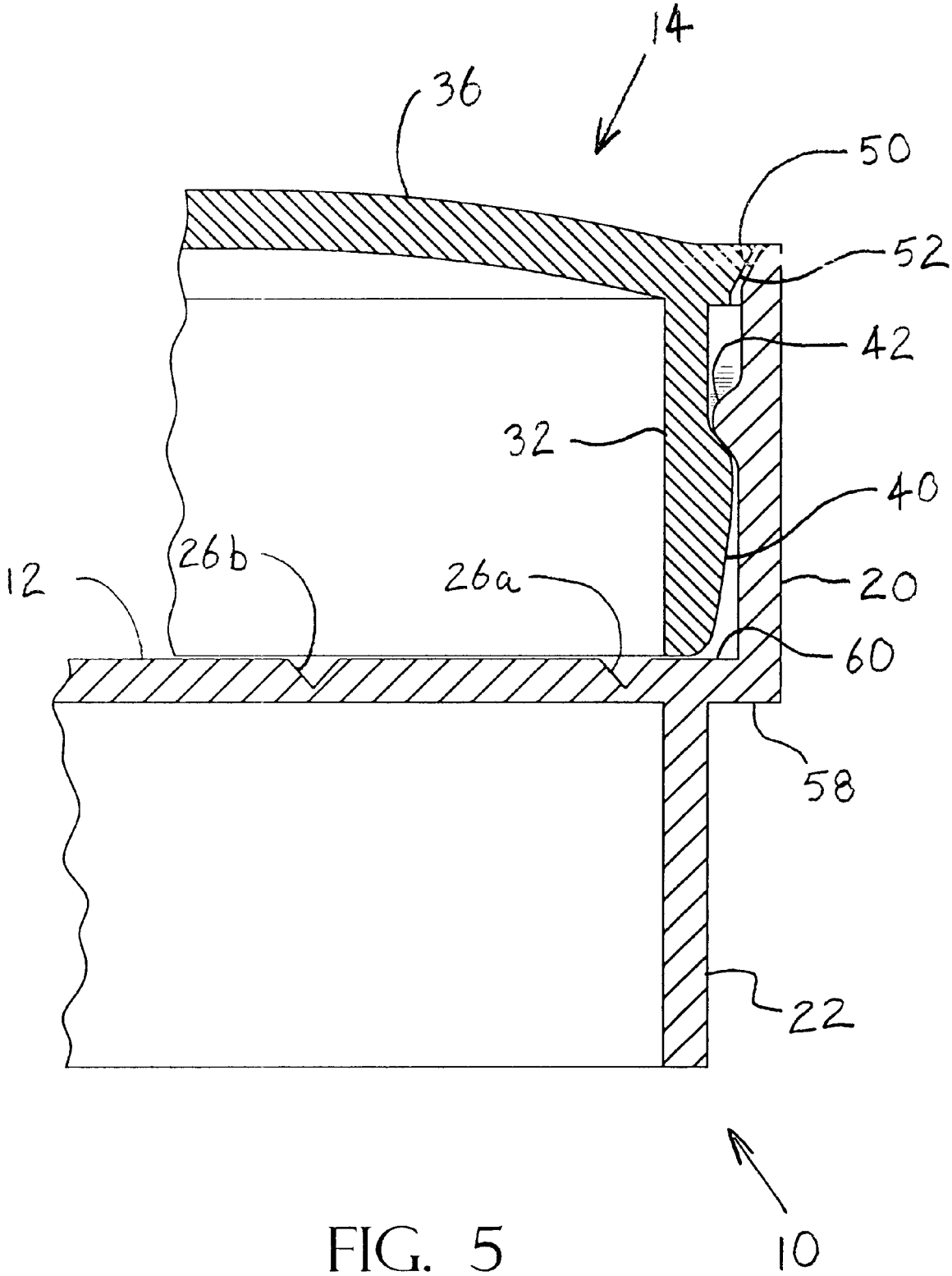
FIG. 5 is an enlarged fragmentary cross-sectional view showing the relationship between the body of the container closure and the lid in its closed position.

FIG. 5 is an enlarged fragmentary cross-sectional view showing the relationship between the body 18 of the container closure and the lid 14 in its closed position. When the lid 14 is in its closed position, the boss 48 on the outer periphery of the apron 38 is located between the locking rib 42 on the skirt 20 and a ledge 60 formed by the offset between the skirt 20 and the flange 22. The lower edge of the apron 38 is in contact with the ledge 60, which prevents the lid 14 from being pushed further into the body 18. The locking rib 42 retains the boss 40, thereby preventing the lid 14 from inadvertently opening. The boss 42 tapers gradually from approximately the mid-height of the apron 38 to its lower edge to aid a user in guiding the lid 14 into the body 18 and sliding the boss 40 over the locking rib 42. The chamfer 52 on the peripheral edge of the cover 36 generally matches the bevel 50 adjacent the upper edge of the skirt 20. The surfaces of the chamfer 52 and bevel 50 are as close fitting as practicable to prevent contaminants from getting into the space between the apron 38 and the skirt 20 above the locking rib 42 when the lid 14 is in its closed position.

Although the invention has been described and illustrated with respect to an exemplary embodiment thereof, it should be understood by those skilled in the art that the foregoing and various other changes, omissions and additions may be made therein and thereto, without parting from the spirit and scope of the present invention.

We claim:

1. A closure for a container, comprising:

a body having an inner periphery and an outer periphery, the inner periphery defining an opening; and a removable seal made of a thin, tearable material, the seal engaging the inner periphery of the body and covering the opening defined thereby, the seal including a tear strip defined by a pair laterally spaced-apart grooves in the seal and having a starting end, and a finger grip located adjacent the starting end of the tear strip, the finger grip having a pair of gripping tabs which are substantially parallel to the seal, each gripping tab having a proximal and a distal end, the proximal ends being connected to the seal at a position adjacent one another and the distal ends projecting away from one another.

2. The closure of claim 1 wherein the gripping tabs are spaced apart from the seal by a spacer, the spacer being attached at one end to the tear strip and at the opposite end to the gripping tabs.

3. The closure of claim 1 wherein the distal ends of the gripping tabs are angled upwardly and outwardly from the strip to form a V-shape.

4. The closure of claim 1 further comprising a lid which removably engages the body and covers the frangible seal.

5. The closure of claim 1 wherein the body further comprises a flange which projects away from the seal for sealingly engaging an inner periphery of a container, the finger grip being located on the side of the seal opposite the flange.

6. The closure of claim 5 wherein the flange has an upper end and wherein the body further comprises a skirt having an inner periphery, an outer periphery and an upper edge, the skirt being connected to the upper end of the flange and projecting away therefrom, the outer periphery of the skirt being offset from the outer periphery of the flange such that the outer periphery of the flange engages an inner surface of a container and the outer periphery of the skirt is flush with an outer surface of the container.

7. The closure of claim 6 further comprising a lid having a cover and an apron, the cover having an outer periphery and the apron having an inner periphery and an outer periphery, the cover removably covering the seal and the outer periphery of the apron removably engaging the inner periphery of the skirt.

8. The closure of claim 7 wherein the skirt further comprises a locking rib its inner periphery and the apron further comprises a boss around its outer periphery, such that the cover is retained by a snap fit between the locking rib and the boss when the lid is in its closed position.

9. The closure of claim 8 wherein the removable lid further comprises a tether, the tether having a first end attached to the outer periphery of the cover and a second end attached to the outer periphery of the skirt adjacent the seal.

10. The closure of claim 8 wherein the lid further comprises a lifting tab which is attached to the outer periphery of the cover substantially opposite the tether and projects beyond the outer periphery of the skirt when the lid is in its closed position.

11. The closure of claim 9 wherein the tether is located in a first notch in the upper edge of the skirt when the lid is in its closed position such that the upper surface of the tether is substantially flush with the upper edge of the skirt.

12. The closure of claim 10 wherein the lifting tab is located in a second notch in the upper edge of the skirt when the lid is in its closed position such that the upper surface of the lifting tab is substantially flush with the upper edge of the skirt.

13. A closure for closing an open end of a container having a tubular sidewall, comprising:

a flange having an inner periphery, an outer periphery, an upper edge, and a lower edge, the outer periphery being securable to an interior surface of a sidewall of a container;

a frangible seal engaging the flange;

a skirt having an upper edge, a lower edge, an inner periphery and an outer periphery, the lower edge of the skirt being connected to the upper edge of the flange such that at least a portion of the lower edge of the skirt forms a shoulder for engaging an edge of a container sidewall, the outer periphery of the skirt being offset outwardly from the outer periphery of the flange by a distance substantially equal to the thickness of the sidewall such that when the closure is installed onto a container, the outer periphery of the skirt is substantially flush with an exterior surface of the container; and a lid which removably engages the inner periphery of the skirt.

14. A reclosable closure for a container, comprising:

a skirt having an inner periphery, an outer periphery, a lower edge, and an upper edge, the inner periphery defining an opening;

a lid removably engaging the skirt and including a cover that is substantially coextensive with the opening, the cover having a peripheral edge, an outside face and an inside face, the peripheral edge being located adjacent the upper edge of the skirt, the outside face being substantially flush with the upper edge of the skirt at a portion of the cover adjacent the skirt and the inside face being located substantially opposite the outside face;

a tether attached at one end to the peripheral edge of the cover and at the opposite end to the skirt;

a tab attached to the peripheral edge of the cover substantially opposite the tether and projecting away from the cover in substantially parallel relation to the plane defined by the upper edge of the skirt;

wherein the tether is located within a first notch in the upper edge of the skirt such that an upper surface of a portion of the tether at the notch is substantially flush with the upper edge of the skirt and the tab is located within a second notch in the upper edge on the skirt such that the upper surface of a portion of the tab at the second notch is substantially flush with the upper edge of the skirt; and a frangible seal supported adjacent the lower edge of the skirt.

15. A container closure for closing an open end of a container having a tubular sidewall, comprising:

a frangible seal made of a thin, tearable material, the seal having a removable portion which is defined by an edge groove in the seal, the seal also having a tear strip defined by a pair of spaced-apart grooves, the tear strip comprising a starting end defined by a connecting groove which connects the spaced-apart grooves; and a finger grip which includes a spacer and a pair of gripping tabs, the spacer being attached to the tear strip adjacent the starting end and each gripping tab having a proximal end and a distal end, the proximal ends being attached to the spacer opposite the tear strip and the distal end projecting upward and outward from the spacer to form a V-shape;

a flange having an inner periphery and an outer periphery, the flange being attached to the seal adjacent the edge groove in the seal and projecting away from the seal, the flange for engaging the interior surface of a side wall of a container;

a skirt having an inner, an outer periphery, an upper edge and a locking rib located on its inner periphery, the skirt being attached to the flange and projecting away from the seal in a direction substantially opposite from the flange, the outer periphery of the skirt offset from the outer periphery of the flange by a distance substantially equal to the thickness of a sidewall of a container such that when the closure is attached to the container, the outer periphery of the skirt is flush with the outside surface of the sidewall;

a removable lid having a cover and an apron, the cover having an outer periphery and the apron having an inner periphery, an outer periphery and a boss on its outer periphery the cover removably covering an opening defined by the inner periphery of the skirt and the apron removably engaging the inner periphery of the skirt, the boss for providing a snap fit with the locking rib on the skirt when the lid is in its closed position and the lid further including a lifting tab which is attached to the outer periphery of the cover and project away therefrom; and a tether attached at one end to the cover opposite the lifting tab and at the opposite end to the outer periphery of the skirt adjacent the seal;

wherein the lifting tab and the tether are each retained in a respective notch in the upper edge of the skirt such that the upper surfaces of the lifting tab and the tether are substantially flush with the upper edge of the skirt.

* * * * *